United States Patent [19]

Cochran, II

[11] 4,308,304

[45] Dec. 29, 1981

[54] ANTISTATIC TUFTED PRODUCT

[76] Inventor: William H. Cochran, II, P.O. Box 32, Stonington, Conn. 06378

[21] Appl. No.: 871,402

[22] Filed: Jan. 23, 1978

Related U.S. Application Data

[63] Continuation of Ser. No. 304,342, Nov. 7, 1972, abandoned, which is a continuation-in-part of Ser. No. 872,657, Oct. 30, 1969, Pat. No. 3,713,960, and Ser. No. 20,200, Mar. 17, 1970, Pat. No. 3,728,204, and Ser. No. 54,640, Jul. 13, 1970, Pat. No. 3,702,797, which is a continuation-in-part of Ser. No. 765,267, Oct. 4, 1968, abandoned.

[51] Int. Cl.[3] ..... D03D 27/00; H05F 3/00; D04H 11/00

[52] U.S. Cl. ..... 428/95; 156/72; 156/48; 428/922

[58] Field of Search ..... 428/95, 922; 156/72, 156/148

[56] References Cited

U.S. PATENT DOCUMENTS

| | | | |
|---|---|---|---|
| 2,302,003 | 11/1942 | Cadwell et al. | 139/420 |
| 2,713,016 | 7/1955 | Weiss | 428/251 |
| 3,075,867 | 1/1963 | Cochran | 156/93 |
| 3,158,518 | 11/1964 | Kessler | 428/95 |
| 3,288,175 | 11/1966 | Valko | 57/139 |
| 4,062,993 | 12/1977 | Seward | 428/95 |

*Primary Examiner*—William J. Van Balen

*Attorney, Agent, or Firm*—Cushman, Darby & Cushman

[57] ABSTRACT

A tufted product comprising a primary backing material having pile yarn projecting through its top surface and including an electrically conductive metal foil, the pile yarn being tufted through the primary backing fabric including the electrically conductive foil so that the yarn is in direct contact with the foil so as to render the product antistatic.

2 Claims, 3 Drawing Figures

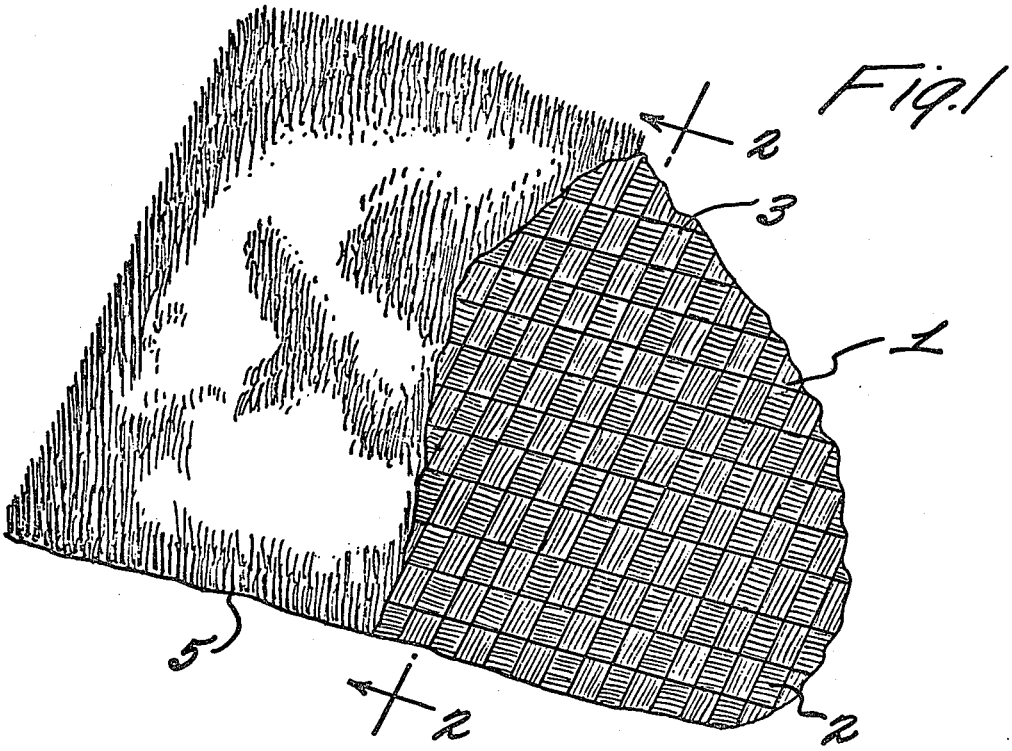
Fig. 1
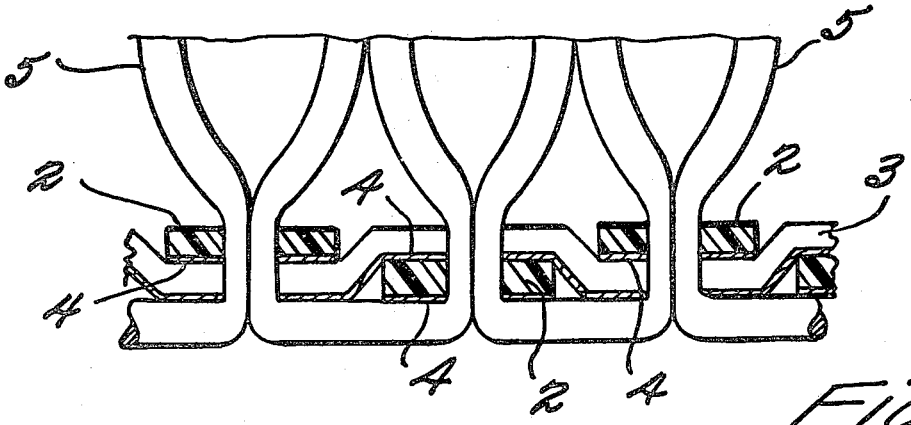
Fig. 2
Fig. 3
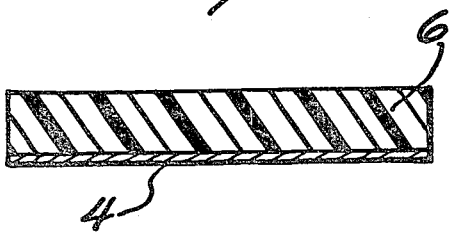

ANTISTATIC TUFTED PRODUCT

This is a continuation of application Ser. No. 304,342, filed Nov. 7, 1972, now abandoned, which is a continuation-in-part of Ser. No. 872,657 filed Oct. 30, 1969, now U.S. Pat. No. 3,713,960 issued Jan. 30, 1973, and of Ser. No. 020,200 filed Mar. 17, 1970, now U.S. Pat. No. 3,728,204 issued Apr. 17, 1973, and of Ser. No. 054,640 filed July 13, 1970, now U.S. Pat. No. 3,702,797 issued Nov. 14, 1972, which is a continuation-in-part of Ser. No. 765,267 filed Oct. 4, 1968, now abandoned.

The subject matter of Ser. No. 872,657; Ser. No. 20,200; and Ser. No. 54,640 is hereby incorporated by reference.

The present invention is concerned with a tufted product, e.g. carpeting, carpet tile, wall-covering or the like, having improved antistatic properties.

It is well known that products having a pile surface of nylon, wool or other fibers tend to generate and/or accumulate undesirable amounts of static electricity in use causing shocks, sparking and the like. Numerous techniques have been used to overcome this problem of static generation and/or accumulation, but most of these suffer from one disadvantage or another. For example, pile surfaces are coated with antistatic agents but while such coatings can be effective for a time, they tend to wear off or come off during cleaning. The antistatic coating can also undesirably affect the appearance and/or feel of the product and increase its apparent soiling rate.

Another approach to the problem is to include conductive metal fibers or wires in the pile yarn but this may undesirably affect the appearance of the product and it adds considerably to the cost thereof. Additionally, conductive metal fibers or wires dull cutting knives used in the manufacture and/or installation of the product. A further disadvantage is that special types of conductive backsizings may be required in order for this alternative to be fully effective.

The purpose of the present invention is to obviate prior art difficulties in obtaining antistatic effects in a tufted product. Other objects will also be apparent.

Broadly speaking, the objects of the invention are realized by providing a tufted product comprising a primary backing material, e.g. a self-supporting film or more preferably a woven or nonwoven fabric, having a tufted surface of pile yarn which would normally tend to accumulate and/or generate static electricity and electrically conductive material, preferably but not necessarily aluminum foil, attached to the primary backing material, the pile yarn being tufted through the primary backing material and the electrically conductive material attached thereto so that there is intimate contact between the pile yarn and the conductive material. The electrically conductive material may be grounded by itself, or directly to an external ground or to or through means constituting a part of the tufted product, e.g. a conductive back sizing and/or cushion joined, if necessary, to an external ground.

The success of the invention is based on the finding that the more surface area of the pile yarn of a tufted product which is in direct and intimate contact with a conductor, linked to or itself forming a ground, the less the generation and/or accumulation of static charge. Antistatic performance is improved by any close contact between the pile and conductor, and it is important only to provide the degree of contact necessary to reduce static electricity generated and/or accumulated below the point where it is noticeable when the product is used. The invention provides a convenient way for obtaining the desired contact between the pile yarn and the conductor by tufting the yarn through the primary backing material and the conductor.

The tufted product of the invention may be made in a variety of ways. Conventional forms of primary backing materials may be used provided the conductor is applied before tufting to at least part of one surface thereof, usually the back side. Primary backing fabrics for tufted carpets conventionally comprise either woven jute or woven or nonwoven polypropylene or similar plastic material, or films thereof, all of which are themselves generally poor conductors. A particularly useful type of primary backing fabric is shown in U.S. Pat. No. 3,110,905 wherein the backing fabric is woven from strips of polypropylene or like synthetic plastic material which are rectangular in cross section. Other primary backing fabrics, woven or nonwoven, are made from more conventional types of fibers, filaments or yarns which are essentially round in cross section. As noted above, the conventionally known primary backing materials are not generally conductive but by applying conducting foil or the like over at least part of one or both surfaces of such fabric before tufting, according to the invention, the pile yarn after tufting will necessarily be in substantial contact with the conductor and thereby provide a way for avoiding the generation and/or accumulation of static charges.

The conductor may be applied to the primary backing fabric in any convenient fashion depending on the nature of the backing fabric and the conductor employed. Advantageously, the conductor is a conductive metal foil, e.g. aluminum foil, which can be heat sealed or adhesively, dielectrically or otherwise bonded (such as needle bonded) to the primary backing fabric. One way of making a primary backing fabric from polypropylene or similar synthetic plastic involves forming a film of the plastic; drawing the film, usually while hot, to orient; cooling; and then slitting the film into appropriate widths after which the resulting strips of plastic are woven to form the primary backing fabric; for example, the structure shown in U.S. Pat. No. 3,110,905. The sequence of drawing and slitting as set forth above may be reversed but both of these methods can be readily adapted to use the present invention. Specifically, the conductive metal may be bonded to the film or otherwise associated therewith after the film has been drawn and oriented (if orientation is necessary). This may be done before or after slitting the film. The result is, in essence, a bicomponent yarn comprising a strip of polypropylene or similar plastic laminated to the foil. This yarn can then be woven into a primary backing fabric as, for example, in the case of U.S. Pat. No. 3,110,905, care being taken to minimize twisting or turning of the yarn so that the foil is preferably essentially entirely on the back side of the primary backing fabric. Both warp and filling may include the foil or it may be preferred to use the foil in either the warp or filling alone. In addition to its effect on static charge generation or accumulation, use of the foil as described has the following advantages:

(1) the heat-conducting properties of foil tend to provide even temperature distribution over the entire area where the product is used; and (2) chemical adhesion of polypropylene and similar plastic materials to conventional back sizing, secondary backing fabric and their adhesives, and cushioning materials is easier to obtain with aluminum foil than with exposed polypropylene or other conventional plastics used in primary backing fabrics. Such improved chemical adhesion has the further advantage of minimizing fraying of cut edges of the tufted product and improves bond to cushioning materials or the like as in the case of onepiece carpeting;

(3) in order to minimize pile yarn costs, it is desirable to minimize the thickness of the primary backing material and the foil, being very thin, permits this to be accomplished.

As one alternative to the above, a conductive layer may be deposited on any of the conventional types of primary backing fabrics by applying a conductive material in latex or solution form followed by drying prior to tufting. This may be accomplished by immersing the primary backing fabric in the latex or solution of conductive material or by roller coating, spraying, etc. This alternative is also helpful to prevent or reduce the tendency of primary backing fabrics to fray at cut edges. The conductive material thus applied also adheres chemically better to conventional back sizings, secondary backing fabric adhesives and/or cushioning materials in the case of one-piece carpeting than to exposed polypropylene or similar plastic material.

The invention is illustrated in the accompanying drawing wherein

FIG. 1 is a perspective view of a tufted carpet prepared according to the invention while FIG. 2 is a vertical sectional view along the line 2—2 of FIG. 1 and FIG. 3 is another vertical sectional through a typical warp or fill for use in making the present primary backing fabric.

As illustrated, the primary backing fabric (1) comprises strips of polypropylene or the like woven as warp (2) and filling (3) in the manner of, for example, U.S. Pat. No. 3,110,905. Heat sealed or otherwise bonded to the underside of the strips (2) and (3) is a thin aluminum foil (4) or like conductor. Typically, the foil may be 0.0002" to 0.0005" thick, dead soft, clean aluminum, surface treated or plain. It is desirable to use the thinnest foil practical so that hand of the finished product is minimally affected and foil cost is minimized. Conductive foils other than aluminum foil may be used and, while the conductor is shown applied to both warp and fill in the drawing, it will be appreciated that the conductor may be attached to the underside of only the warp or filling as desired.

The pile surface of the product is represented in the drawing by the numeral (5), it being noted that in keeping with the invention the pile yarn is tufted through the primary backing after the foil (4) has been applied to the backing so as to provide the desired areas or points of contact between the pile yarn and foil. A ground, not shown, may also be connected to the conductive component and, if desired, the product may include other conventional components, e.g. a secondary backing fabric attached to the backside of the tufted product. Either a conventional or a conductive back sizing may also be applied to the product as desired.

FIG. 3 shows, in vertical section, the yarn used as filling and/or warp to prepare the tufted product described above, the numeral (6) representing the polypropylene or other plastic material constituting the strip and (4) being the foil or other conductive layer.

It will be appreciated from the foregoing that various modifications may be made in the invention as described above. For instance, while the foregoing description shows application of the conductive foil to the back of the primary backing fabric, there may be circumstances which will permit application of the foil or the conductive material to the top of the fabric although the back is usually preferred. As an illustration, the material to which the pile of a flocked fabric is anchored may be a conductive substance with the same desirable antistatic results. Alternatively the pile yarn may be tufted through and, therefore, in direct and intimate contact with, a conductive screen used as a primary backing fabric. A further embodiment of the invention contemplates the use of a plastic film coated with aluminum foil or other conductive material or combined with a woven or nonwoven fabric, in the manner of U.S. Pat. No. 3,075,865, made of conductive fibers for use as a primary backing material to achieve the desired antistatic results.

It will be evident from the above that various combinations of materials may be used with conductive foil or the equivalent. For present purposes, for example, laminates may be formed comprising two or more layers of plastic film, woven and/or nonwoven textile materials, e.g. nonwovens formed by needlepunching or polymer films which fibrillate on tufting, with one or more layers of conductive metal foil placed thereon or therebetween. For instance, a conductive aluminum foil may be laid against the top and/or bottom surface of a support material, such as on a backing material for, or on one ply of, a needlepunched product prior to the time it is needlepunched so that the foil is incorporated in the resulting needlepunched product; or such as on cross-oriented polypropylene films or the like and the resulting laminate tufted to pierce the foil and give the desired product wherein the pierced foil and yarn constituting the pile surface are in direct contact. Alternatively, the needlepunched product so produced may be used by itself as an antistatic and/or flame retardant textile product.

The foil can also be laid on the top or bottom surface of a woven fabric, as contemplated above, with the resulting laminate tufted to give the desired product. Various combinations of these embodiments are also obviously possible.

It will be recognized that tufting through laminate formed by combining the backing material and the foil will pierce the foil at many points and, in the circumstances, the foil may lose its identity as a foil in the finished product. Accordingly, use of the term "foil" in the claims herein contemplates the situation where a foil is used initially regardless of the ultimate condition of the foil after tufting.

It should also be noted that apart from the antistatic properties which are realized with the present invention, important further advantages of the product are its flame retardant and fire resistant characteristics because of the use of the foil. These latter characteristics are obviously of considerable importance from the standpoint of safety in use. The foil, because it is an excellent thermal conductor, serves as a heat sink and, because it is a nonporous substance, serves as a convection barrier and, because of its physical properties, is a heat reflector. All of these properties are highly desirable, particularly in the case of carpeting, the foil serving not only to dissipate static electricity but also functioning to improve thermal insulating value and fire resistance of the carpeting or the like. It will also be appreciated that the foil increases the fire resistance of carpet underlay, whether separate or attached to the carpet, because of the heat conductive and reflective properties of the foil.

The scope of the invention is defined in the following claims wherein:

I claim:

1. A fabric composition comprising a fabric base, a heat conductive initially continuous sheet-form metal foil overlying said base, a non-woven batt of fibers overlying said metallic foil, and a plurality of interlocks joining the base, the foil and the batt and more specifically comprising a plurality of tufts of fibers extending in one direction through said foil through spaced apart needle punched apertures in the foil without impairing the unbroken thermal conductivity continuity of the foil between the apertures, said batt and said foil being locked to said base solely by said fibers of said batt which have been pushed through said foil and said base to form fiber masses which are locked against the bottom of said base, said foil forming unbroken continuous conductive paths to conduct heat away from a point of application to said composition for dissipation throughout the fabric composition.

2. The method of making a heat dissipating fabric which comprises applying a continuous metallic foil over a web of a fabric base, applying a non-woven batt of fibers over said foil and needle punching the resulting composite, said needle punching forming plural interlocks to securely interlock said fabric base, said foil and said batt together, whereby said foil forms continuous conductive paths in the fabric to conduct heat away from a point of application to said composition for dissipation throughout the composition.

* * * * *